US009932197B1

(12) United States Patent
Doke et al.

(10) Patent No.: US 9,932,197 B1
(45) Date of Patent: Apr. 3, 2018

(54) DOCUMENT FOLDER HAVING A CONTROLLED DROP FEEDER

(71) Applicant: Cornerstone Automation Systems, LLC, Frisco, TX (US)

(72) Inventors: Michael J. Doke, Frisco, TX (US); Brandon Lee Roby, Frisco, TX (US); Joseph Bradly Woodard, Frisco, TX (US)

(73) Assignee: Cornerstone Automation Systems, LLC, Frisco, TX (US)

( * ) Notice: Subject to any disclaimer, the term of this patent is extended or adjusted under 35 U.S.C. 154(b) by 103 days.

(21) Appl. No.: 15/224,084

(22) Filed: Jul. 29, 2016

Related U.S. Application Data

(60) Provisional application No. 62/198,771, filed on Jul. 30, 2015.

(51) Int. Cl.
*B65H 37/06* (2006.01)
*B65H 29/34* (2006.01)

(52) U.S. Cl.
CPC ..... *B65H 37/06* (2013.01); *B65H 29/34* (2013.01)

(58) Field of Classification Search
CPC ..... B65H 29/34; B65H 37/06; B65H 45/04; B65G 1/1373; B65G 1/137
See application file for complete search history.

(56) References Cited

U.S. PATENT DOCUMENTS

| | | | | | |
|---|---|---|---|---|---|
| 3,477,591 | A * | 11/1969 | Andersson | B65H 29/34 | 193/39 |
| 4,799,661 | A * | 1/1989 | Nail | B42C 1/12 | 209/576 |
| 5,114,128 | A * | 5/1992 | Harris, Jr. | B42C 1/10 | 270/1.03 |
| 5,897,733 | A * | 4/1999 | Stevens | B42D 15/08 | 156/227 |
| 9,211,692 | B2 * | 12/2015 | Graushar | B65H 45/28 | |
| 2012/0326427 | A1 * | 12/2012 | Boos | B65H 31/06 | 281/15.1 |
| 2014/0318078 | A1 * | 10/2014 | Kondo | B65B 57/10 | 53/54 |

* cited by examiner

*Primary Examiner* — Jennifer Simmons

(57) ABSTRACT

This disclosure describes various aspect of a unique standalone document handler that is coupable to and controllable by a fulfillment. The standalone documents handler is attachable to a standard printer or copier and has a drop chute that is designed to hold groups of fulfillment documents and drop them into a fulfillment receptacle positioned under the document handler. Upper and lower scanners scan document identification codes placed on one or more pages of the fulfillment document, which allows a system controller to control the timing of dispensing the correct documents in the designated fulfillment receptacle at the correct time.

20 Claims, 7 Drawing Sheets

DOCUMENT FOLDER HAVING A CONTROLLED DROP FEEDER

CROSS-REFERENCE TO RELATED APPLICATION

This Application claims the benefit of U.S. Provisional Application Ser. No. 62/198,771 filed on Jul. 30, 2015, entitled "DOCUMENT FOLDER HAVING A CONTROLLED DROP FEEDER," commonly assigned with the present invention and incorporated herein by reference.

TECHNICAL FIELD

This application is directed to a standalone document handler that has a controlled drop feeder mechanism that can be used in an automated fulfillment system.

BACKGROUND

With the advent of internet retailers and large suppliers in general, order and shipment fulfillment has grown significantly within the last decade or so. The broad availability of internet access has allowed consumers to purchase retail items and even prescription medicines on line while sitting in the comfort of their own homes. To fulfill these order requests, retailers have developed various fulfillment systems in an attempt to keep pace with the growing number of consumer requests. Often times, these fulfillment systems include conveying an open shipment box or carrier along a conveyor system and along the way an employee will place the purchased item or items, along with any accompanying documentation, into the open box. Large retail fulfillment businesses, such as Amazon®, have built multi-billion dollar corporations around such fulfillment systems. Markets anticipate that the business of order fulfillment will continue to grow as more customers make more purchases of items on line, including medication and prescription drugs.

SUMMARY

One aspect of this disclosure provides a standalone document handler comprising a document receiving system that has a driven roller system adjacent a holding platform. The roller system is aligned with the platform to convey a document received from a printer onto the holding platform. A driven document pusher is movably positioned with respect to the holding platform and is oriented to push the document from the holding platform into a folding path. A folding system comprising a driven folding blade, opposing guide plates, and two or more opposing pairs of driven rollers are aligned with the folding path. A drop chute is aligned with the folding system, and includes, a driven document support member. The driven document support member is operatively coupled to a system controller, and the driven document support member extends across a width of the drop chute to support a document thereon. The support member is movable to release the document from the drop chute. At least one scanner is located adjacent the holding platform or the drop chute. The scanner is coupable to a system controller to scan document identification data located on a folded document.

Another embodiment of this disclosure is directed to a fulfillment system. This embodiment of the fulfillment system comprises a main fulfillment system controller including microprocessors, memory, communication circuity, and software algorithms associated therewith to provide coordinated instructional commands to the fulfillment system. This embodiment further includes a standalone document handler coupled to the main fulfillment system. The standalone document handler comprises, a document receiving system that has a driven roller system adjacent a holding platform. The roller system is aligned with the platform to convey a document received from a printer onto the holding platform. A driven document pusher is movably positioned with respect to the holding platform and is oriented to push the document from the holding platform into a folding path. A folding system comprising a driven folding blade, opposing guide plates, and two or more opposing pairs of driven rollers are aligned with the folding path. A drop chute is aligned with the folding system, and includes, a driven document support member. The driven document support member is operatively coupled to a system controller. The driven document support member extends across a width of the drop chute to support a document thereon. The support member is movable to release the document from the drop chute. This embodiment further includes at least one scanner located adjacent the holding platform or the drop chute. The scanner is coupable to a system controller to scan document identification data located on a folded document. This embodiment also includes a printer coupled to the main fulfillment system controller and a conveyor system coupled to the main fulfillment system controller. The conveyor system is configured to deliver a fulfillment receptacle to a correct fulfillment position located under the standalone document handler.

BRIEF DESCRIPTION

Reference is now made to the following descriptions taken in conjunction with the accompanying drawings, in which.

DETAILED DESCRIPTION

Figure 1:
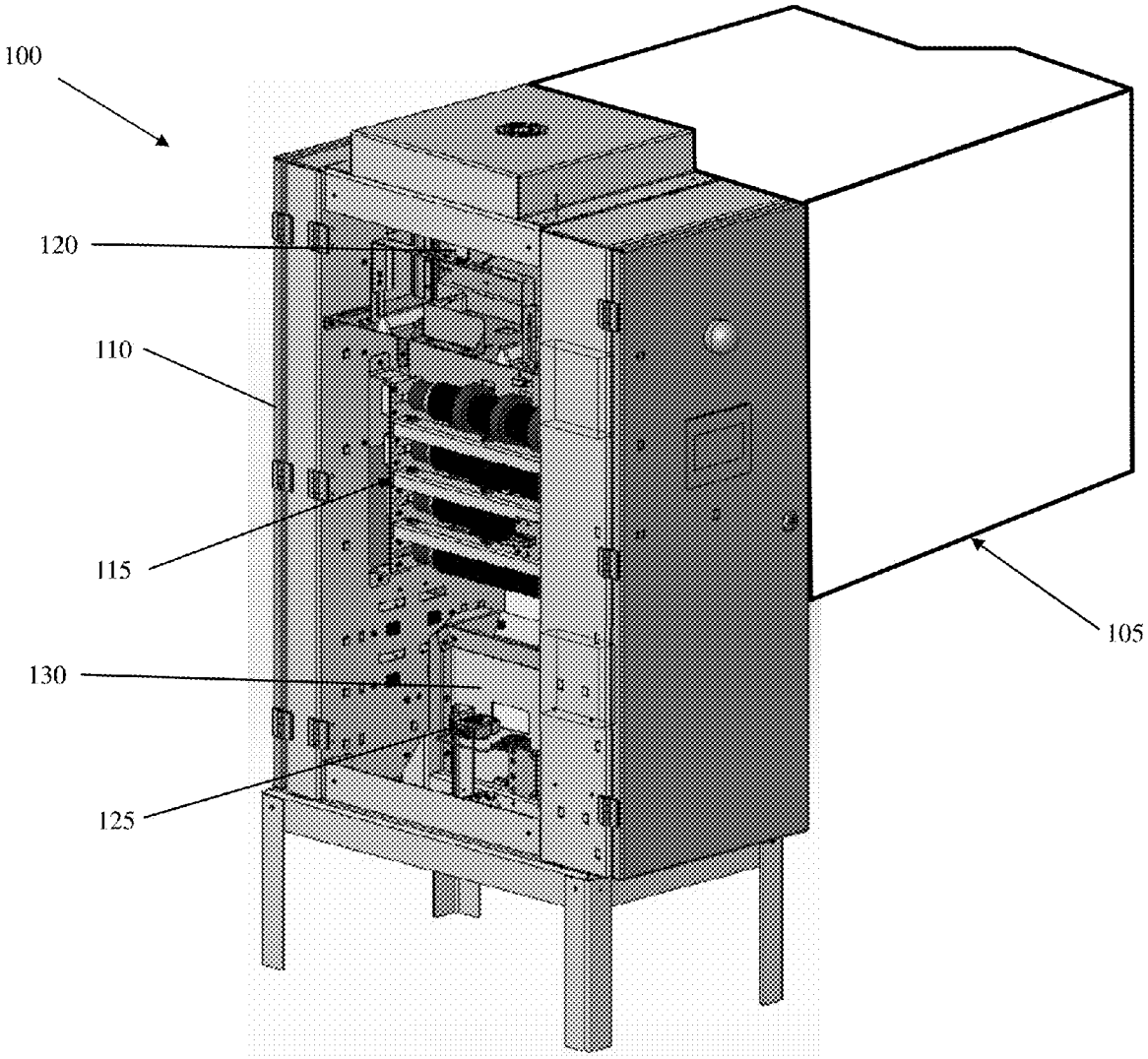
FIG. 1 illustrates a perspective view of one embodiment of the document handler provided by this disclosure.

This disclosure describes various embodiments of a unique standalone document handler that has a drop chute for use in a fulfillment system, such as a conveyor belt system upon which a receptacle, such as totes or other container boxes travel. The document handler is coupable to and operates with a conventional printer or copier (hereinafter "printer"), but among other things, the document handler includes a drop chute that is capable of holding groups of documents and dropping them from the drop chute when the correct fulfilment receptacle positions under the document handler. Additionally, embodiments of the document handler include upper and lower scanners, such as conventional optical scanners, that scan document identification codes placed on one or more pages of the document by the associated printer. Scanners scan the identification code into the memory, which allows a system controller of the document handler to control the timing of dispensing the correct documents in the designated container at the correct time. As discussed herein, the system controller may be a main fulfillment system controller that controls other operations and equipment of a fulfillment process. In other embodiments, the system controller may be a sub-system controller located with the document handler that communicates with the main fulfillment system controller. It should be understood that both the main fulfillment system controller and the sub-system controller may be present in the embodiments discussed herein. When both are present, they are programmable to work together to control the document fulfillment process. The document handler also includes communication circuitry that allows the document handler to communicate wirelessly or by hard wire with the main fulfillment system controller or sub-system controller. As just mentioned, the document handler may include a sub-controller that locally controls the document handler pursuant to command signals received from the main fulfillment system controller.

Generally, the overall fulfillment system comprises one or more controllers or sub-controllers that have a sufficient number of microprocessors, memory, communication circuitry, and software algorithms associated therewith to provide instructional commands to the document handler and other various fulfillment apparatus to provide coordination of the fulfillment process. The one or more controllers may communicate, wirelessly or by hard wire, with one or more sub-controllers located at each given fulfillment station, or it may communicate with sub-controllers associated with individual pieces of equipment, such as the embodiments of the document handler presented herein, that are used in the automated fulfillment system. Alternatively, a number of individual controllers may cooperatively communicate, wirelessly or by hard wire, with each other to direct the various functions of the fulfillment system.

As presented herein, the document handler deliver documents to the designated fulfillment container in a coordinated fashion. However, one type of fulfillment container that works well with the document handler is a securable tote, as disclosed in U.S. Provisional Application No. 62/182,795, filed on Jun. 22, 2015, incorporated herein in its entirety by reference. As recited in the incorporated reference, the securable tote includes a covering belt with a window opening in that secures the tote when in transport and rotates belt to an open position when positioned to receive a fulfillment article, such as a document. One advantage of the tote is that it provides a secure transportation environment that prevents unintended access during the fulfillment process, which insures higher accuracy of correct fulfillment items and otherwise prevents unauthorized removal of fulfillment items from the tote during the fulfillment process. This feature is highly advantageous in those systems where controlled medications, such as narcotics, constituent all or a portion of the fulfillment items. Additionally, in certain embodiments, the tote has identification data located thereon that allow the system controller to identify the tote, its contents, and location in real-time.

In this disclosure and in the claims, unless otherwise specified, the terms "including," "include," "have," "having," "comprise," and "comprising" and various grammatical forms thereof, are used in an open-ended fashion, and thus should be interpreted to mean "including, but not limited to. Additionally, unless otherwise specified, the terms "driven" or "driving, as used herein and in the claims, includes mechanisms, including conventional mechanisms, such as pneumatic, hydraulic, electromagnetic or motorized mechanisms that are operatively coupled to the stated component and have the necessary physical or mechanical structure to operate the component in a functional manner within the fulfillment system. Unless otherwise specified, the term "configured," as used herein and in the claims, means that the recited component has the necessary physical or mechanical structure to operate in a functional manner within the fulfillment system. Unless otherwise specified, any use of any form of the terms "connect," "engage," "couple," "attach," or any other term describing an interaction between elements is not meant to limit the interaction to direct interaction between the elements but include indirect interaction between the elements described, as well.

FIG. 1 illustrates a perspective view of one embodiment of a standalone document handler 100, as provided herein, operatively coupled to a conventional printer 105, that a supplier may use in a fulfillment system to fill a documentation portion of a purchaser's order. As used herein, a "standalone" document handler is a document handler whose housing is coupable to a standard printer and has a document handling mechanism that is physically separate from that of the printer's document handling system. In this embodiment, the document handler 100 has a housing 110 that houses a roller feeding/folding system 115, which may be conventionally driven by pneumatic, hydraulic, electromagnetic or motorized mechanisms. It further includes upper and lower scanners 120, 125, respectively, and a controlled document drop chute 130 located beneath the roller system 115, whose mechanical design/configuration allows the document drop chute 130 to hold or retain one or more groups of documents in a vertical fashion. The illustrated embodiment of the document handler 100 shows a vertical design that operates in a vertical fashion, such that the document handler 100 feeds documents vertically into a container located underneath the document handler 100. The document receives the paper from a horizontal direction and translates the processing direction to a vertical direction. This is advantageous because the tote or container carrying the fulfillment items positions vertically under the document feeder.

Figure 2:
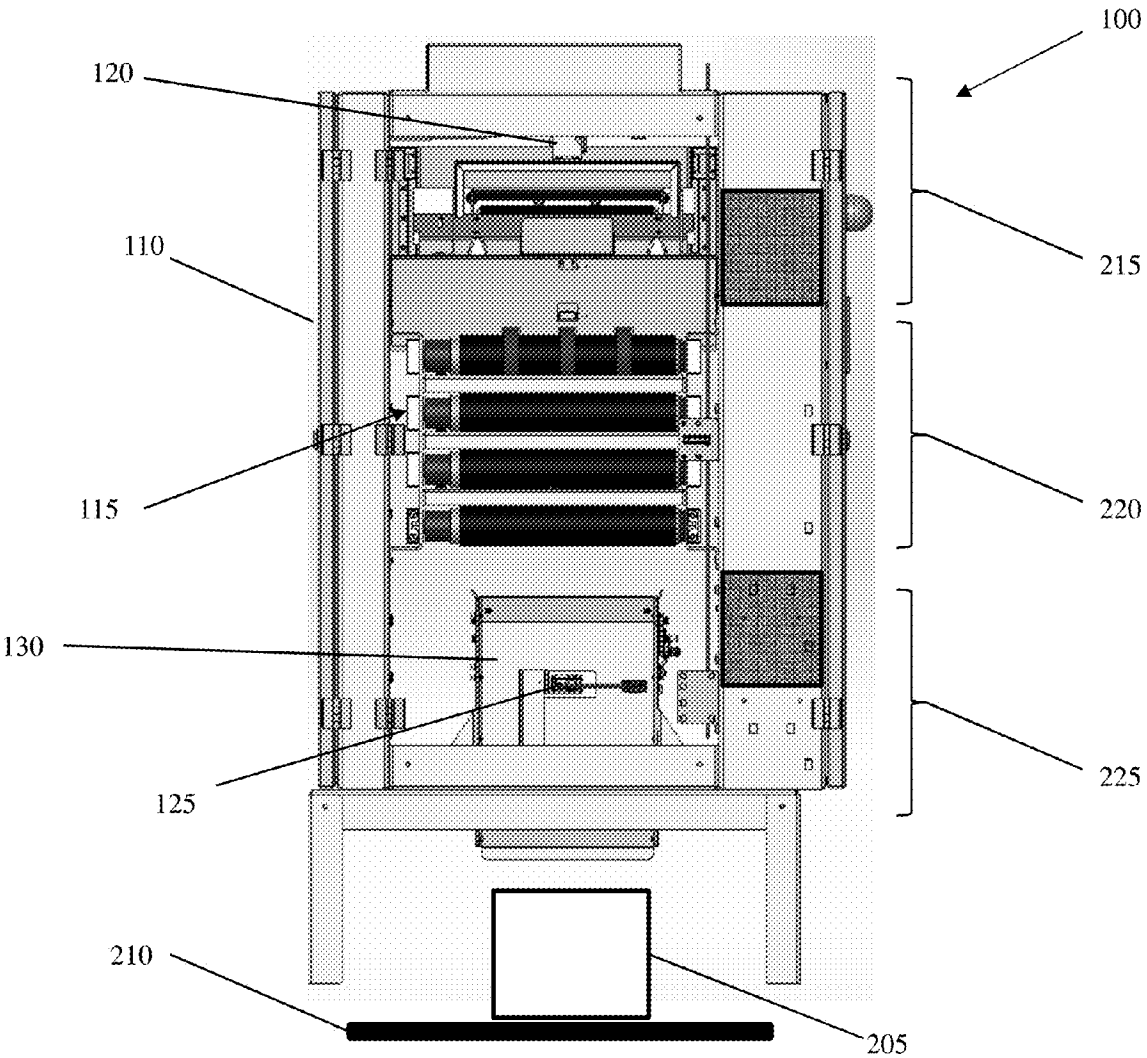
FIG. 2 illustrates a side view of the document handler of FIG. 1.

FIG. 2 illustrates a side view of the embodiment of FIG. 1 that shows the position of a document receptacle 205, such as a tote, or item carrier, and a conventional conveyor system 210 located underneath the document handler 100. The illustrated embodiment has a document receiving system 215, which may also be conventionally driven, as mentioned above. The document receiving system section 215 receives printed documents from a printer 105 (FIG. 1) and a driven document pusher (See, FIG. 4) pushes the document into a driven folding system 220. The folding system 220 folds the document and conveys it to the drop chute 130 where the documents are held until the correct receptacle 205 is located underneath the document handler 100.

Figure 3:
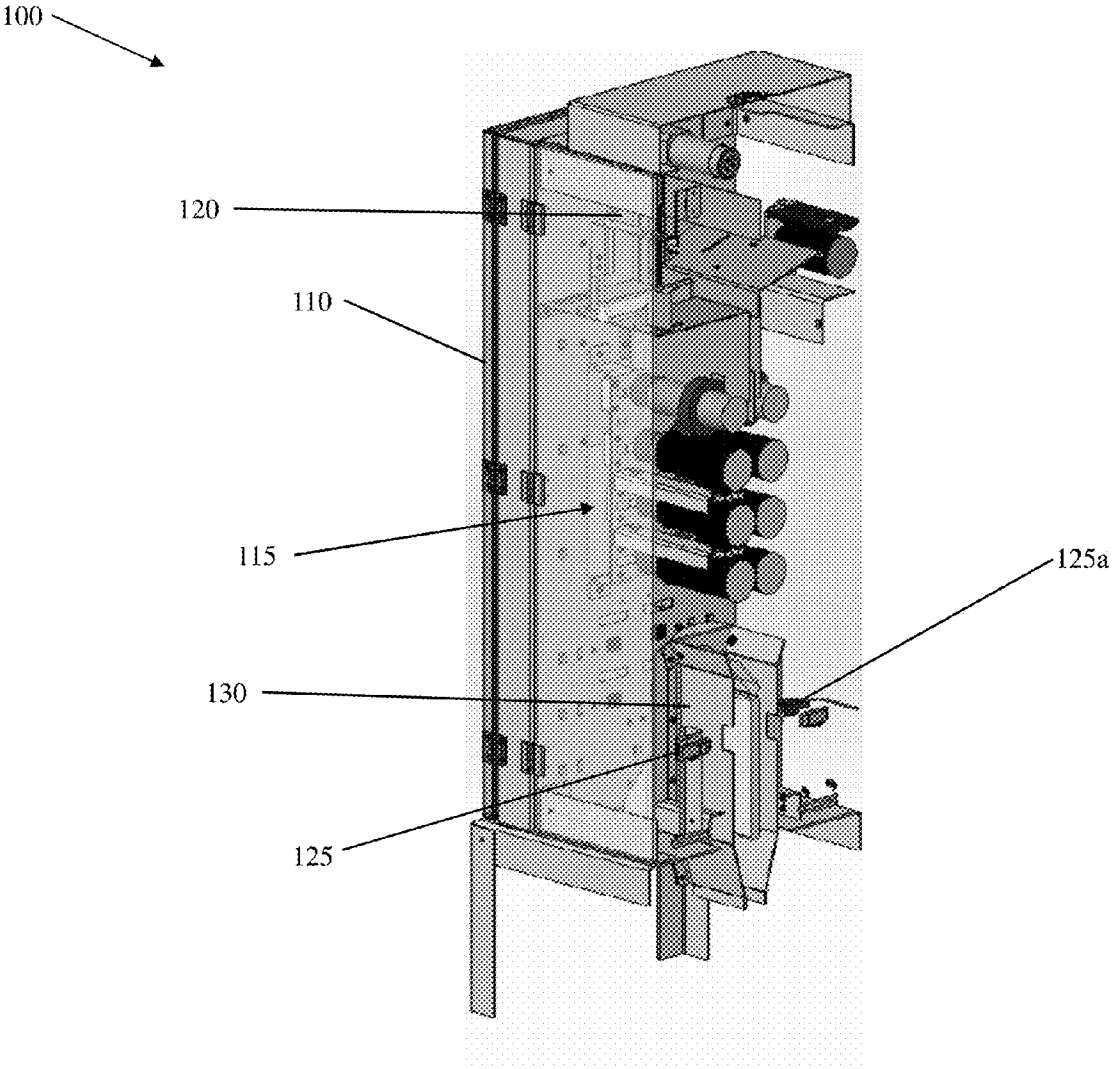
FIG. 3 illustrates a sectional view of the document handler of FIG. 1.

FIG. 3 is a sectional view of the document handler 100 of FIG. 1 that illustrates that certain embodiments may have dual scanners 125, **125*a* located on opposite sides of the drop chute 130. Thus, a scanner is able to read the coded identification data associated with the group of documents, regardless on which side of the drop chute 130** the documents are located. Through this identification data, the system controller knows both the type of documents and their location along the fulfillment conveyor system. This is highly desirable when medication fulfillment is involved, given that such fulfillment systems must be highly accurate in all respects, including documentation fulfillment.

Figure 4:
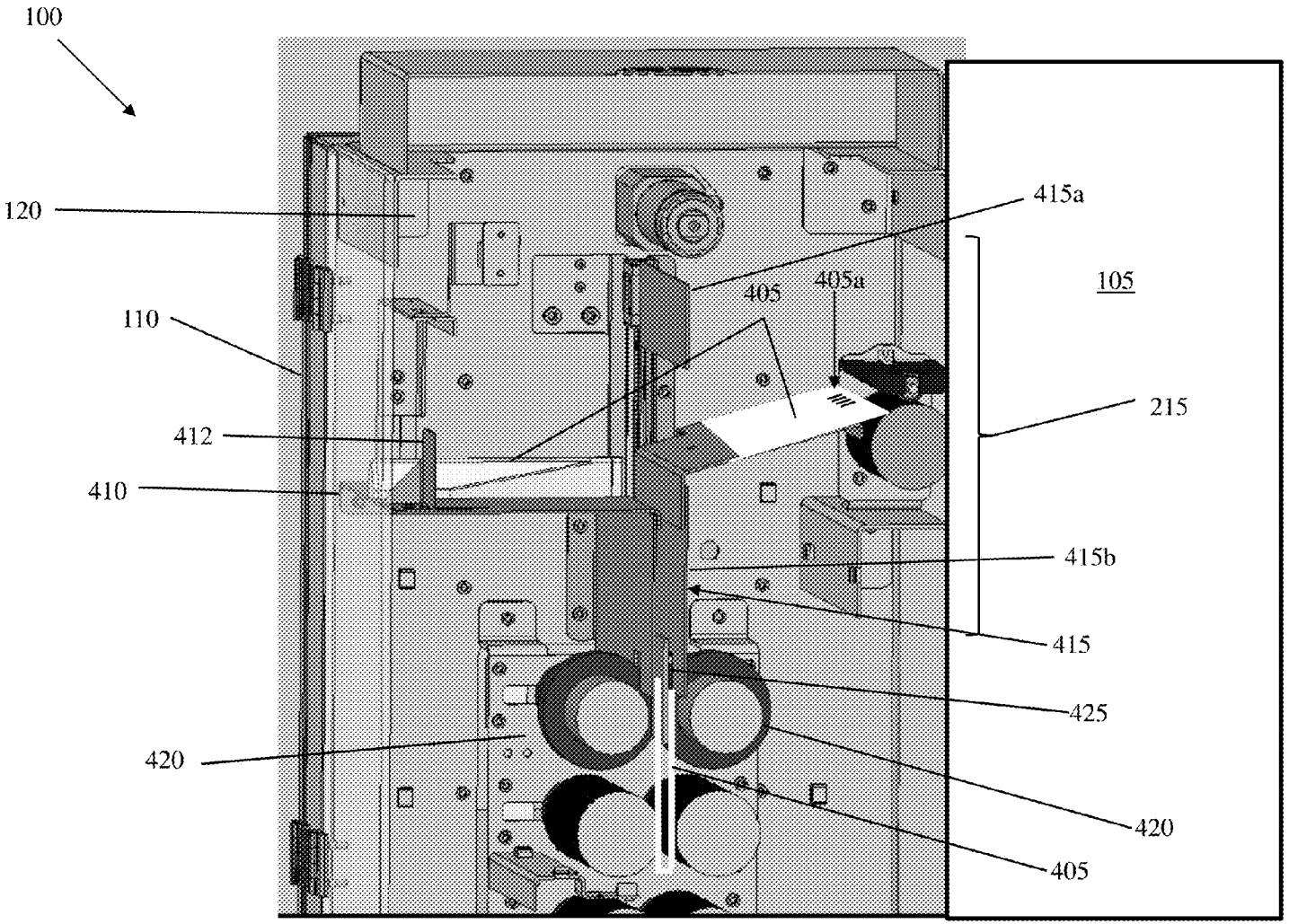
FIG. 4 illustrates an enlarged view of the document handler of FIG. 1 showing the upper paper pushing section.

FIG. 4 illustrates an enlarged view of the document receiving section 215 of the document handler 100 of FIG. 1. The printer 105 prints the document 405, which may consist of one or more pages, and moves it in a generally horizontal direction to position the document 405 onto a holding platform 410. It should be noted that the printer 105 may be equipped with its own sub-controller and communication circuitry that allows it to communicate with and receive instructional commands from the system controller. The document 405 may contain information about the fulfillment item(s) within the fulfillment carrier 205 (FIG. 2), or it may contain information about the purchaser or patient in those instances where the fulfillment items are prescription medication. For example, if the fulfillment item is a medication, the document 405 contains important information about the medication, benefits and side effects, and the patient to whom the medication prescription pertains and how the patient should take the medication, etc.

In one embodiment, the system controller instructs the printer 105 to print document identification data 405*a*, such as a readable code on each page of the document 405 or on the last page of the document 405. The identification data 405*a* may be any type of conventional machine-readable code. The identification data 405*a* is printed on the side that will be the outside face of the document 405 when folded, to allow a scanner to scan the identification data and allow the system controller to identify the document 405 for fulfillment purposes. The scanner 120 or 125 scans the document identification data, after the printer 105 completes the printing of the document 405. Either one or both of the scanners 120, 125 may scan the document. For example, in one embodiment, the scanner 120 may first scan the printed document, and scanner 125 may subsequently scan the folded document. In another embodiment, the document 405 may not be scanned until it is received in the drop chute 130. A document pusher 412 associated with the holding platform 410 slides the document 405 into a folding path 415 of a folding blade 415*a*. The document pusher 412 and folding blade 415*a* may be operatively attached to a conventional driving mechanism, such as a pneumatic, hydraulic, electromagnetic or motorized mechanism. The folding blade 415*a* vertically pushes the document 405 between a pair of guiding plates 415*b*. During this process, the folding blade 415*a* folds the document 405, and an opposing pair of feeding rollers 420 moves the document 405 to the drop chute 130 (FIG. 1). In one embodiment, the feeding rollers 420 are conventionally driven. The feeding rollers 420 of the folding system 220 grab the folded document and move it vertically to the drop chute 130 (FIG. 1). The folding system 220 folds the document 405 so that the identification data is on the outside face of the folded document 405, as generally illustrated in FIG. 4. The guide plates 415*b* has slots 425 located therein that allow the opposing rollers 420 to grab the document efficiently without grabbing the folding blade 415.

Figure 5:
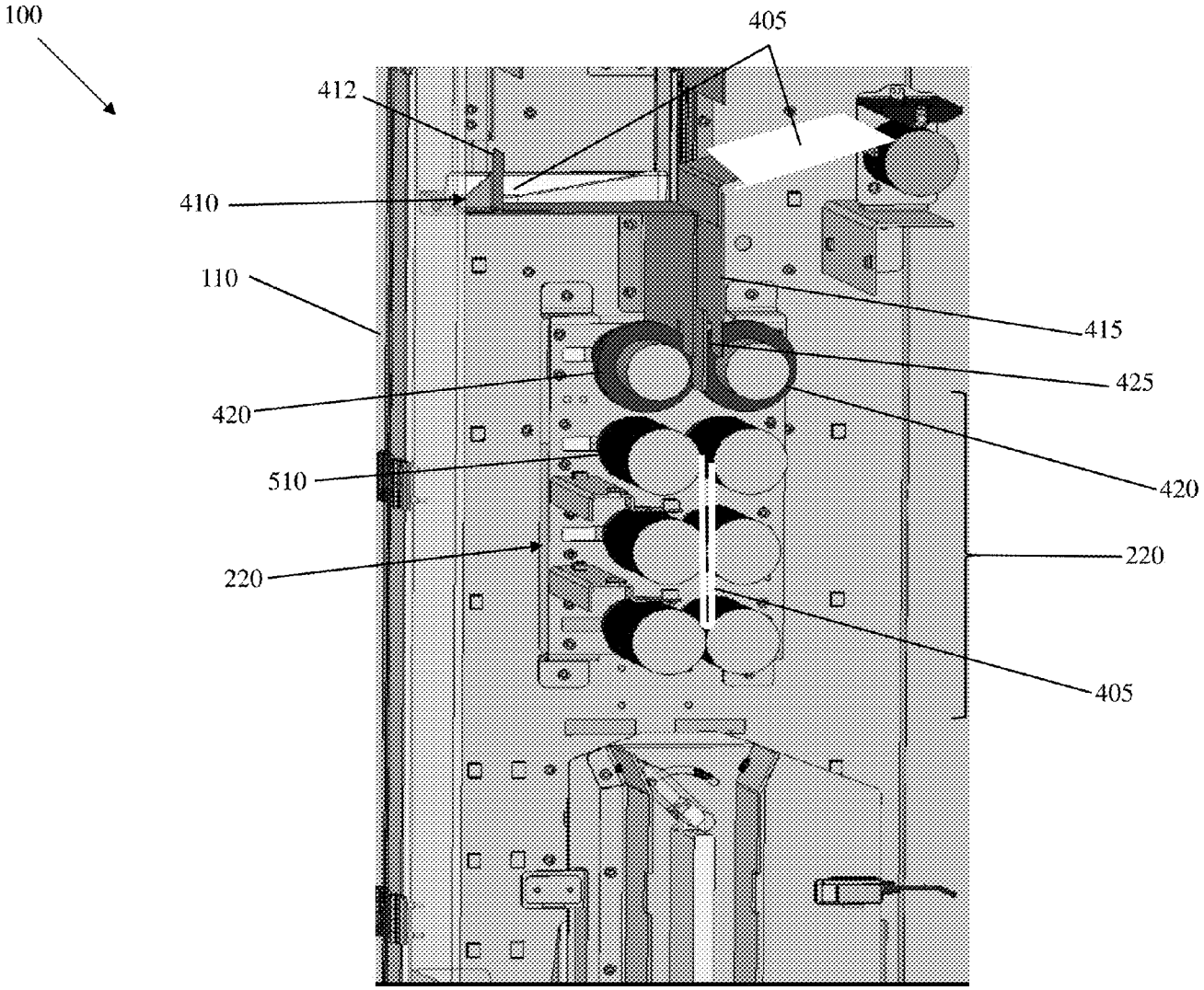
FIG. 5 illustrates an enlarged view of the document handler of FIG. 1 showing the paper folding section.

FIG. 5 illustrates the document 405 traversing the folding section 220 of the document handler 100. In the illustrated embodiment, the folding section 220 further comprises one or more pairs of opposing conventionally driven guiding rollers 510. The guiding rollers 510 may be biased by a spring (not shown), which allows for a variable distance of separation between the rollers 510 to accommodate various thicknesses of the folded document 405. The guiding rollers 510 receive the folded document from the rollers 420 and vertically feed the document 405 into the underlying chute 130 (FIG. 1).

Figure 6:
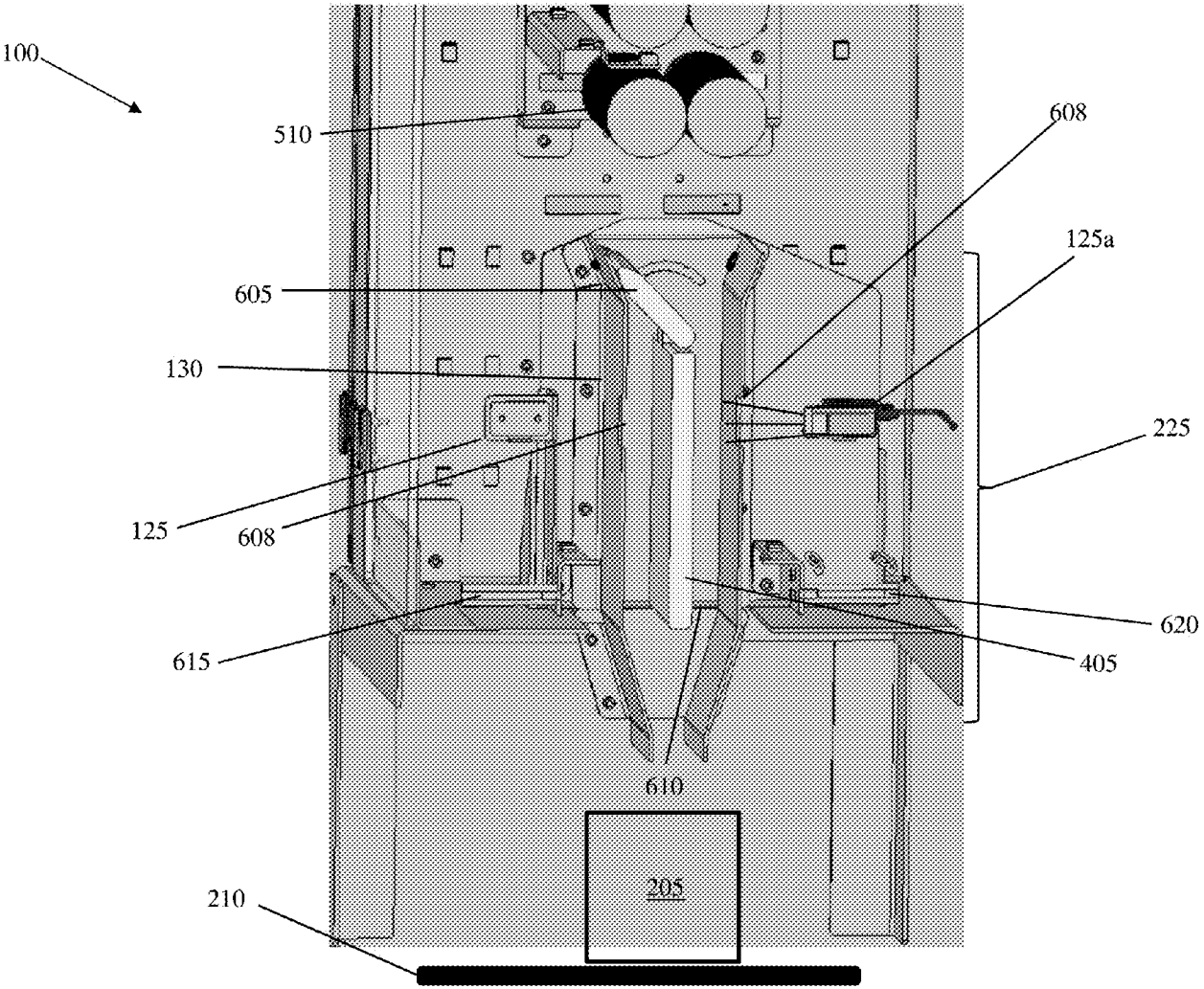
FIG. 6 illustrates and enlarged view of the document handler of FIG. 1 showing the chute section.

FIG. 6 illustrates an enlarged sectional view of the drop chute section 225 of the document handler 100 of FIG. 2. In this embodiment, the drop chute 130 includes a driven document guide 605 that connects to the system controller or connects to the system controller though a sub-controller of the document handler 100. In one embodiment, the document guide 605 conventionally connects to a driver, such as a motor, by a shaft. The driver moves or rotates the document guide 605 to one side of the chute 130 or the other, which allows for different groups of documents 405 to be retained within the drop chute 130 on different sides of the drop chute 130. In some embodiments, the drop chute 130 may include a partition located in the center of the drop chute 130 that divides the drop chute 130 into separate sections. In other embodiments, the document guide 605 is driven by conventional means, such as, motorized, pneumatic, hydraulic, or electromagnetic mechanisms. The position of the pivot point of the document guide 605 is in the middle of the drop chute 130, which allows the document guide 605 to rotate easily from one side to the other of the drop chute 130, as instructed by the system controller. The side-to-side rotation of the document guide 605 guides different groups of documents to different sides of the drop chute 130 for distribution.

When the document 405 positions within the drop chute 130, the identification code is scanned through scanning slots 608 by either scanner 125 or 125*a*, depending on which side of the chute 130 the document 405 is positioned. This identification data is then stored in the fulfillment systems controller. The identification code informs the controller how and when to deposit the document 405 into the correct tote 205.

In one embodiment, a conventionally driven support member 610 extends across the width of the chute 130, as shown, and provides support for the documents 405 until the correct tote 205 arrives underneath the document handler 100. In one embodiment, a support member 610 is a single pin member that slidably attaches to a driver 615 located on one side of the drop chute 130, as illustrated. In one embodiment, the driver 615 is a conventional hydraulic piston device that is attached to the support member 610. When the designated receptacle 205 arrives, and upon command from a system controller, the driver 615 retracts the support member 610 from underneath the appropriate document 405 to allow the document 405 to fall in the receptacle 205. The system controller will appropriately instruct the document handler 100 to release document 405 from the chute 130 first and will position that document 405 on the appropriate side of the drop chute 130 for first release. When the first document group is released, the driver 615 may push the support member 610 back across the chute 130. Alternatively, the support member 610 may remain in its current position, supporting the remaining document group until the next designated tote 205 arrives, at which time, the driver 615 retracts the support member 610 further to release the remaining document group into the underlying tote 205.

In another embodiment, the support member 610 may be two separate pin members that meet in the center of the drop chute 130. In this embodiment, a driver 615, which may also be a conventional hydraulic piston device, is located on one side of the chute 130 and operatively slides the first pin member, and another driver 620 is located on the opposite side of the chute 130 and drives the second pin member. The driver 620 may be known pneumatic, hydraulic, electromagnetic, or motor mechanisms. In the illustrated embodiment, the drivers 615, 620 are pneumatically driven. The respective ends of the opposing pin members connect to their respective drivers 615, 620, such that upon command from a fulfillment system controller, the appropriate pin member retracts to release the designated document group that it supports into the tote 205. The pin members are an example of one embodiment of the support member, and it should be understood that other support structures, such as drop doors may also be used.

Figure 7:
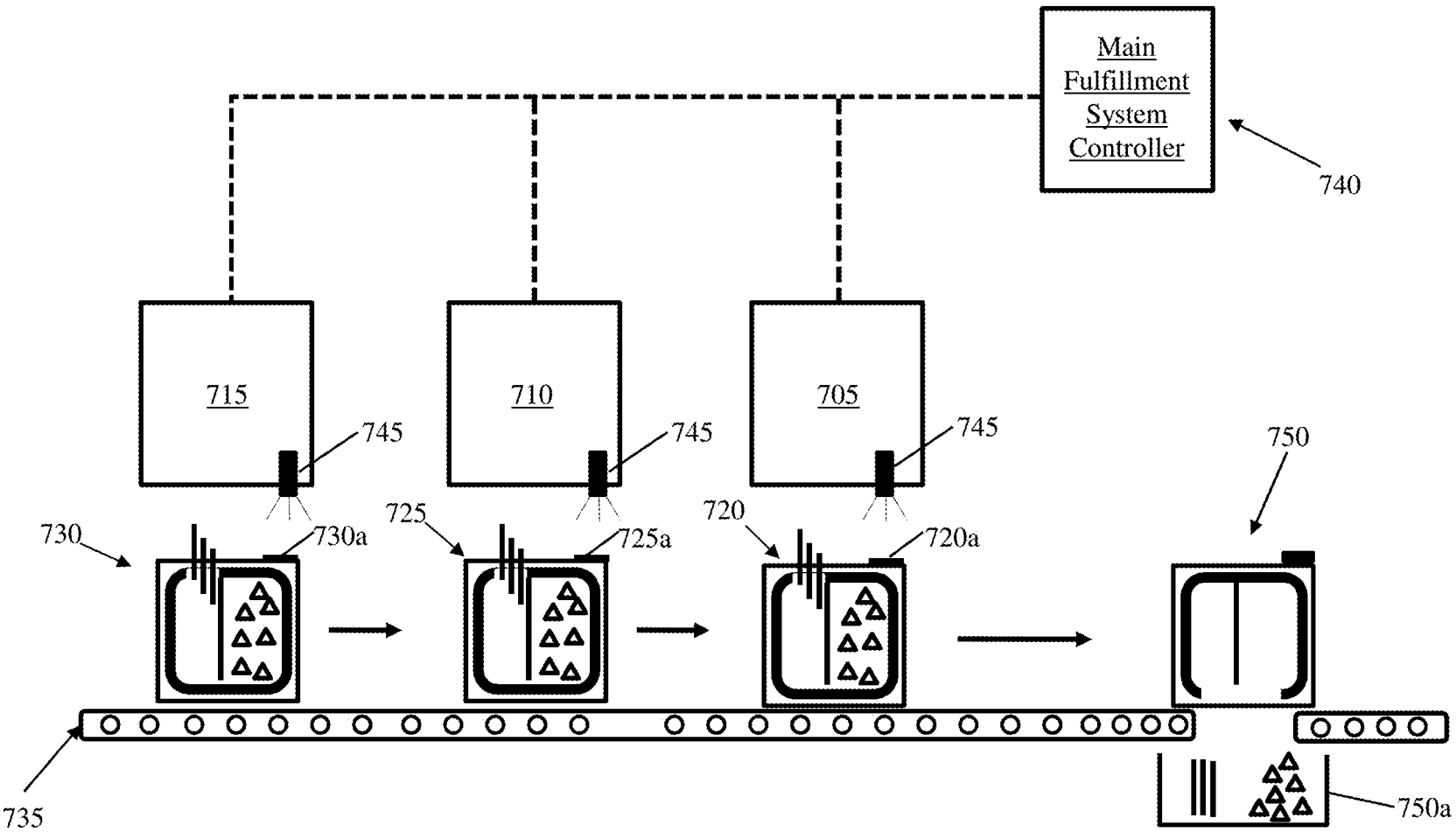
FIG. 7 is a general, schematic view of one embodiment that includes sequence document handlers in a fulfillment process.

FIG. 7 illustrates a schematic view of one embodiment, of how multiple document feeders 100 can be sequenced to expand the processing capabilities of the fulfillment system. The illustrated embodiment comprises sequenced document feeders 705, 710, and 715, as described above, and totes 720, 725, and 730 positioned underneath each of the document feeders by a conveyor system 735, as shown. In the illustrated embodiment, the above-reference system controller is a main fulfillment system controller 740 that instructs not only document handlers 705, 710, and 715, but it also instructs other components of a fulfillment system, such as the conveyor system 735. Though the conveyor system 735 is shown to be a belt conveyor system, it should be understood that the conveyor system 735 includes other types of conveyor systems, such as a manual (e.g. where a person places the tote under a given document handler) conveyor system or a mobile robotic delivery conveyor system. The conveyor systems may be connected to the main fulfillment system controller 740 by hardwire or wirelessly in those instances where the conveyor system 735 is not manual. In those embodiments, where the conveyor system is manual, the person may receive wireless commands from the main fulfillment system by way of textual commands transmitted to a cell phone, a computer tablet or portable laptop or notebook computer. The main fulfillment system controller 740 instructs the conveyor system 740 to position the totes 720, 725, and 730, under the document handlers 705, 710, and 715, as shown and described above.

Each of the totes 720, 725, and 730 has a unique identification code 720*a*, 725*a*, and 730*a* associated with it that the system controller 740 uses to identify the location and contents of each totes 720, 725, 730 within the fulfillment system. The identification data, such as a conventional machine-readable code, is entered into the fulfillment system controller 740 by using a scanner 745, such as a conventional optical scanner, scanning their identification codes, as they travel along the fulfillment conveyor system. At this point of the fulfillment process, each of the totes 720, 725, and 730 contains fulfillment items, such as medication. The medication may be different or the same in each of the totes 720, 725, and 730, or have different combinations of medication. Each of the totes 720, 725, and 730 may have a windowed rotating belt that rotates to an open to allow access to the interior of the respective totes 720, 725, and 730. When the totes 720, 725, and 730 arrive at their respective document feeders 705, 710, and 715, as shown, the belt positions the window to expose only the document compartment of the interiors of the respective totes 720, 725, and 730.

The document feeder 705 may contain two groups of documents, as described above. Either one or both of these documents may be intended for tote 720. If only one document is intended for tote 720, the second or remaining document may be intended for a subsequent tote, such as tote 725. If both are intended for tote 720, the fulfillment system controller will operate the document feeder 705 in a manner described above and release both documents into the tote 720.

After receiving its documents, the fulfillment system will convey tote 720 to a conventional packaging station 750 during which the tote's 720 fulfillment items are emptied into a shipping bag or box. The window is positioned at the bottom of the tote 720, which allows the fulfillment items to drop from the tote 720, as illustrated. In the illustrated embodiment, the contents fall through the tote's 720 open end and into a shipping bag or box 750*a*. The belt may be positioned to successively empty each compartment, or it may be positioned to empty all of the fulfillment items concurrently. Robotics may be located at the packaging station 750 to robotically position the shipping bag or box in place and then seal them to secure the contents. For example, when a bag is used to ship the items, a robotic mechanism positions the bag in place and in some cases may cut an appropriate length of bag that will accommodate all of the fulfillment items. In those instances where the shipping bag is plastic, sealing or heating elements are used to seal either one or both ends of the bags.

In those instances where the shipping container is a box, robotic arms will fold the flaps of the box and secure them in a closed position using an adhesive tape. It should be understood that the positioning and sealing of the shipping container may also be done manually. Each of the remaining totes 725 and 730 proceed through the fulfillment system in a similar manner.

Thus, the document feeder as presented herein can be used in a controlled fulfillment system to accurately deliver the correct documents to the tote or container to which those documents pertain. A plurality of these document feeders can be arranged in sequence to accommodate multiple progressive totes conveyed along a fulfillment system conveyor ins an accurate and timely fashion.

Those skilled in the art to which this application relates will appreciate that other and further additions, deletions, substitutions and modifications may be made to the described embodiments.

What is claimed is:

1. A standalone document handler, comprising:

a document receiving system and having a driven roller system adjacent a holding platform, said roller system being aligned with said platform to convey a document received from a printer onto said holding platform;

a driven document pusher movably positioned with respect to said holding platform and oriented to push said document from said holding platform into a folding path;

a folding system comprising a driven folding blade, opposing guide plates, and two or more opposing pairs of driven rollers aligned with said folding path;

a drop chute aligned with said folding system, and including, a driven document support member, said driven document support member being operatively coupled to a system controller, said driven document support member extending across a width of said drop chute to support a document thereon and being movable to release said document from said drop chute; and at least one scanner located adjacent said holding platform or said drop chute, said scanner coupable to a system controller to scan document identification data located on a folded document.

2. The standalone document handler of claim 1, wherein said at least one scanner is an optical scanner.

3. The standalone document handler of claim 1, wherein said at least one scanner is a first scanner and said standalone document handler further comprises a second scanner.

4. The standalone document handler of claim 3, wherein said first scanner is located adjacent said holding platform and oriented to scan document identification data, and said second scanner is located adjacent said drop chute and oriented to scan document identification data.

5. The standalone document handler of claim 4, further comprising a third scanner, wherein said second and third scanners are located on opposite sides of said drop chute.

6. The standalone document handler of claim 1 wherein said drop chute further includes a driven document guide member centrally located within said drop chute and being rotatable to guide a document to either side of said drop chute.

7. The standalone document handler of claim 1, wherein said driven document support member is a first pin member and said drop chute further comprises a second pin member, wherein said first and second pin members contact one another in a central location of said drop chute.

8. A fulfillment system, comprising:

a main fulfillment system controller including microprocessors, memory, communication circuitry, and software algorithms associated therewith to provide coordinated instructional commands;

a standalone document handler coupled to said main fulfillment system, comprising:

a document receiving system and having a driven roller system adjacent a holding platform, said roller system being aligned with said platform to convey a document received from a printer onto said holding platform;

a driven document pusher movably positioned with respect to said holding platform and oriented to push said document from said holding platform into a folding path;

a folding system comprising a driven folding blade, opposing guide plates, and two or more opposing pairs of driven rollers aligned with said folding path;

a drop chute aligned with said folding system, and including, a driven document support member, said driven document support member being operatively coupled to a system controller, said driven document support member extending across a width of said drop chute to support a document thereon and being movable to release said document from said drop chute; and at least one scanner positioned located adjacent said holding platform or said drop chute, said scanner coupable to a system controller to scan document identification data located on a folded document;

a printer coupled to said main fulfillment system controller; and a conveyor system coupled to said main fulfillment system controller and configured to deliver a fulfillment receptacle to a correct fulfillment position located under said standalone document handler.

9. The fulfillment system of claim 8, wherein said standalone document handler includes a sub-controller coupled to said main fulfillment system controller.

10. The fulfillment system of claim of claim 8, further comprising a plurality of said standalone document handler and said printer.

11. The fulfillment system of claim 8, wherein said conveyor system is a driven belt conveyor system coupled to said main fulfillment system controller and that extends under said standalone document handler.

12. The fulfillment system of claim 8, wherein said conveyor system is a driven, mobile, robotic conveyor system configured to move said fulfillment receptacle to said standalone document handler and position said fulfillment receptacle under said standalone document handler.

13. The fulfillment system of claim 8, wherein said fulfillment receptacle is a securable tote and configured to cooperate with said conveyor system to move said tote from an open position to a closed position.

14. The fulfillment system of claim 13, wherein said tote includes identification data located thereon, said conveyor system including a scanner and said main fulfillment system controller configured to identify said tote and a real-time location of said tote within said fulfillment system.

15. The fulfillment system of claim 8, wherein said at least one scanner is an optical scanner.

16. The fulfillment system of claim 8, wherein said at least one scanner is a first scanner and said standalone document handler further comprises a second scanner.

17. The fulfillment system of claim 16, wherein said first scanner is located adjacent said holding platform and oriented to scan document identification data, and said second scanner is located adjacent said drop chute and oriented to scan document identification data.

18. The fulfillment system of claim 17, further comprising a third scanner, wherein said second and third scanners are located on opposite sides of said drop chute.

19. The fulfillment system of claim 8 wherein said drop chute further includes a driven document guide member centrally located within said drop chute and being rotatable to guide a document to either side of said drop chute.

20. The fulfillment system of claim 8, wherein said driven document support member is a first pin member and said drop chute further comprises a second pin member, wherein said first and second pin members contact one another in a central location of said drop chute.

* * * * *